United States Patent [19]

Gosling

[11] 4,183,714

[45] Jan. 15, 1980

[54] LUBRICANT SEALING MEANS FOR A COMPRESSOR SHAFT

[75] Inventor: Martin C. Gosling, High Wycombe, England

[73] Assignee: Compair Industrial Limited, High Wycombe, England

[21] Appl. No.: 851,351

[22] Filed: Nov. 14, 1977

[30] Foreign Application Priority Data

Nov. 23, 1976 [GB] United Kingdom ..... 48865/76

[51] Int. Cl.[2] ..... F04D 29/08

[52] U.S. Cl. ..... 415/112; 415/170 B; 277/3; 277/15; 277/29

[58] Field of Search ..... 415/110, 111, 112, 170 B; 277/3, 15, 29

[56] References Cited

U.S. PATENT DOCUMENTS

| | | | |
|---|---|---|---|
| 2,608,380 | 8/1952 | Rice | 277/15 X |
| 2,820,652 | 1/1958 | Oechslin | 277/3 X |
| 3,452,839 | 7/1969 | Swearingen | 227/3 |
| 3,937,022 | 2/1976 | Swearingen | 277/15 X |

FOREIGN PATENT DOCUMENTS

| | | | |
|---|---|---|---|
| 1206358 | 9/1970 | United Kingdom | 277/3 |

*Primary Examiner*—Leonard E. Smith

*Attorney, Agent, or Firm*—Mawhinney & Mawhinney & Connors

[57] ABSTRACT

A compressor comprises one or more stages each including an impeller mounted for rotation on a shaft and rotatable in an impeller housing. A transmission is drivingly connected to the shaft and a bearing is provided supporting the shaft. Lubrication means are provided for the bearing which provide a continuous lubricant seal around the shaft between the shaft and the bearing to prevent air leaking through the bearing. A chamber is located between the impeller housing and the bearing for collecting excess lubricant and has an outlet for draining lubricant.

6 Claims, 2 Drawing Figures

LUBRICANT SEALING MEANS FOR A COMPRESSOR SHAFT

The invention relates to compressors and provides a compressor comprising at least one stage including an impeller mounted for rotation on a shaft and rotatable in an impeller housing, a transmission drivingly connected to the shaft, a bearing supporting the shaft and means to lubricate the bearing, the lubrication means providing a continuous lubricant seal around the shaft between the shaft and the bearing to prevent air leaking through the bearing, and the compressor further comprising a chamber located between the impeller housing and the bearing and an outlet from the chamber for draining lubricant from the chamber.

Preferably, the lubrication means supplies lubricant under pressure to a part of the bearing spaced from the chamber so that a pressure difference is created across the bearing.

The compressor may further comprise a tank for lubricant connected to the chamber outlet, and valve means for controlling the flow of lubricant from the chamber to the tank.

Preferably the valve means is a flow control means having a high flow rate condition and a low flow rate condition. The valve means is preferably switchable between these two conditions in response to the compressor going on and off load and to control the oil level in the chamber.

Figure 1:
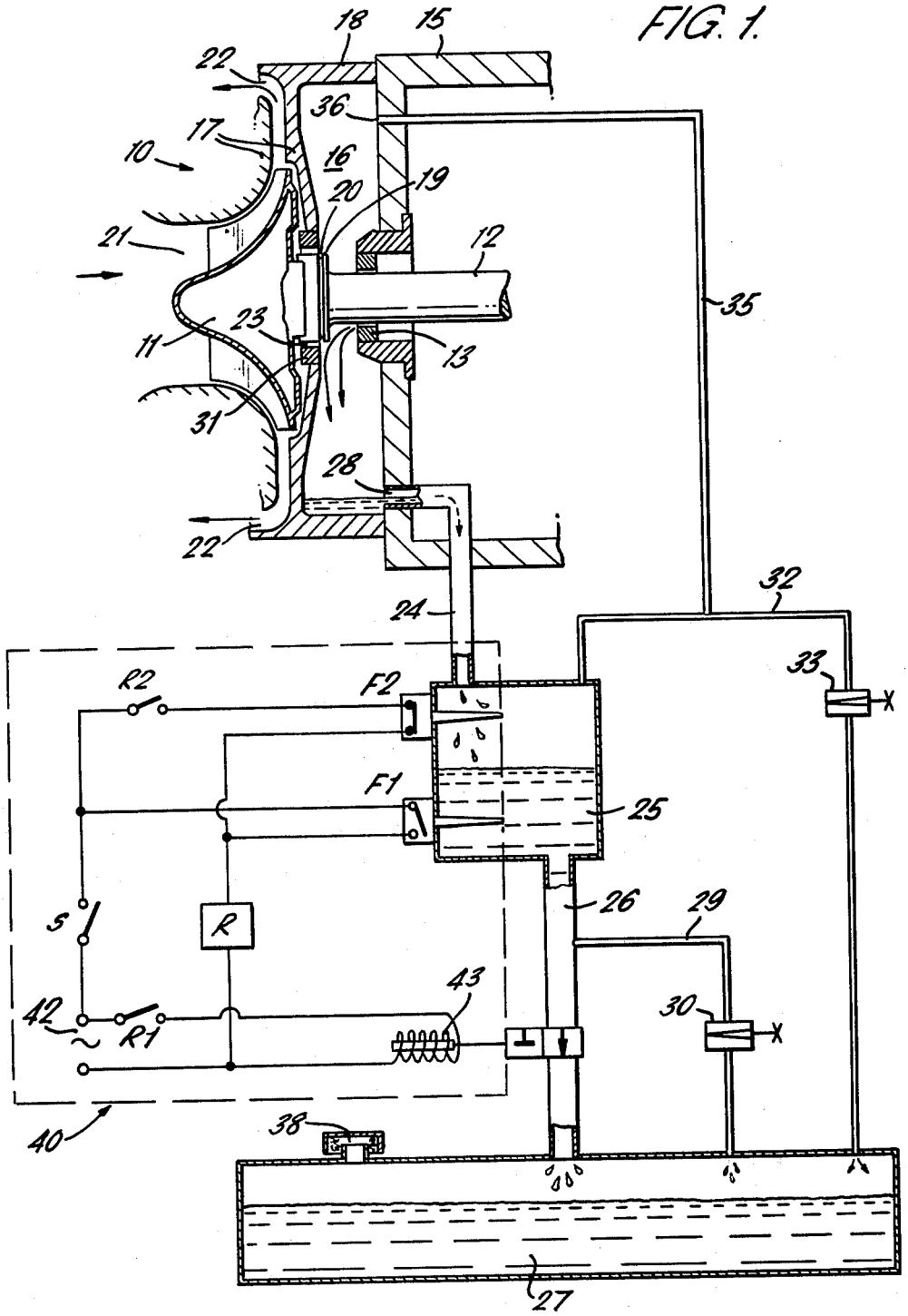
Figure 2:
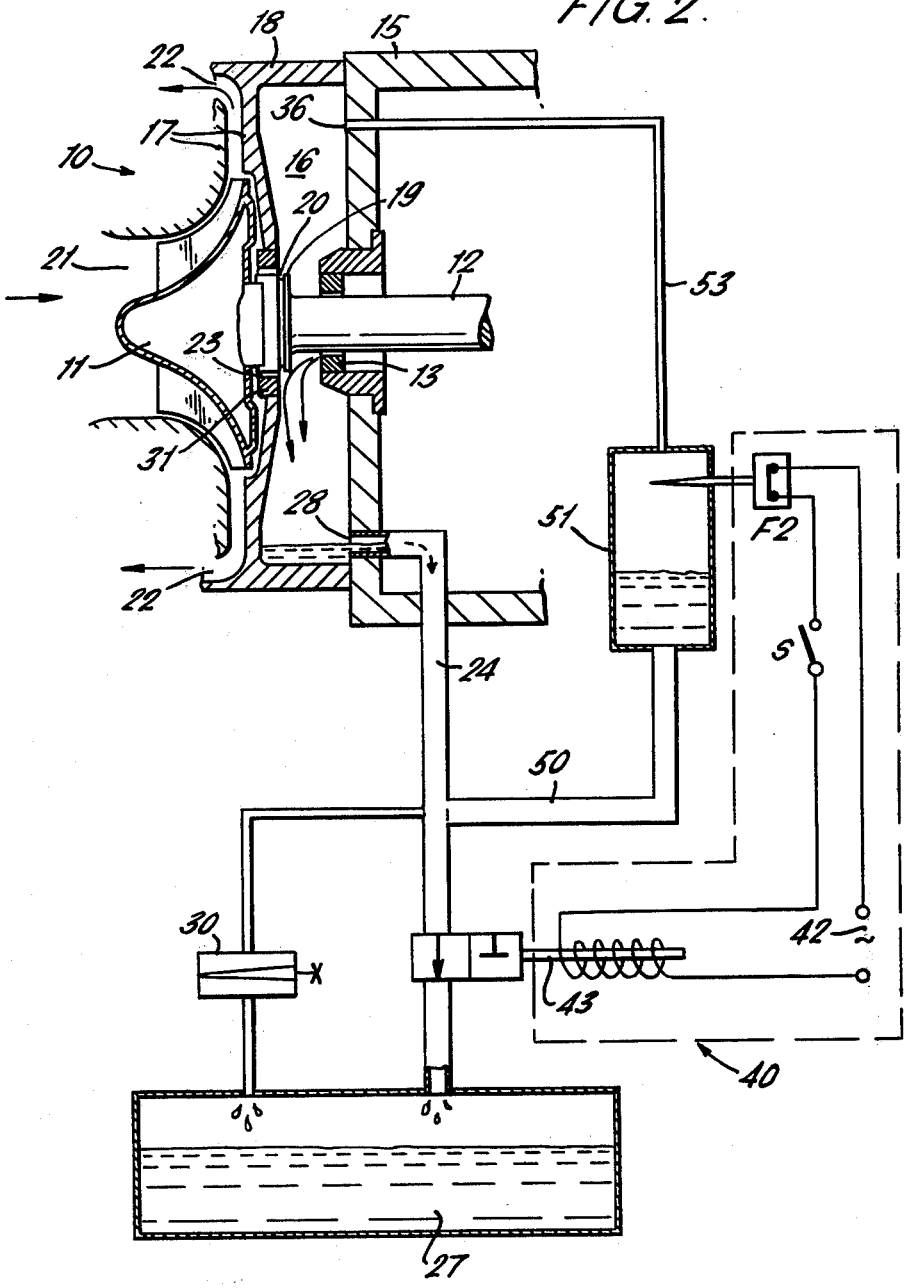

The preferred embodiments of the invention will now be described, by way of example, with reference to the accompanying drawings in which:

FIG. 1 is a schematic drawing of a first embodiment of a compressor stage and its associated oil circuit, and FIG. 2 is a schematic drawing of the compressor stage of FIG. 1 with an alternative oil circuit.

Referring first to FIG. 1, a compressor stage, indicated generally by 10 comprises an impeller 11 mounted on a shaft 12 and rotatable within a housing 17. The shaft 12 is supported in a bearing 13 and is driven from a transmission including a gear train (not shown) contained in a gearbox 15. A chamber 16 is defined between the impeller 11, the impeller housing 17 and the gearbox 15 by a portion 18 of the compressor casing. An annular groove 20 formed in an enlarged portion of the shaft defines a radially extending protruberance 19 on the portion of the shaft 12 within the chamber 16 which acts as an oil flinger as described below.

Air is fed into the compressor stage through inlet 21, is compressed by the impeller 11 and is forced out through outlet 22. A labyrinth seal on "wind back" 31 is provided around the impeller shaft 12 where it passes into the chamber 16 but the seal 31 leaves an annular gap 23 around the impeller shaft 12 which allows a bleed of compressed air into the chamber 16 so that this chamber is maintained under pressure. This pressure is found in practice to be slightly below that which exists at the impeller tip. The gearbox 15 is at ambient pressure.

A drain pipe 24 connects an aperture 28 at the lowermost part of chamber 16 to the top of an oil header tank 25 and a second pipe 26, the tank exit pipe, connects the bottom of the header tank to a main oil tank 27. An oil bleed pipe 29 (of smaller diameter than the second pipe 26) is arranged in parallel with the second pipe 26 and includes a needle valve 30 for controlling the rate of oil bleed.

The top of the oil header tank 25 is also connected by an air bleed pipe 32 including a needle valve 33 to the main oil tank 27 and by an air balance pipe 35 to an aperture 36 in the upper part of the chamber 16. The main oil tank includes an air escape valve or breather 38. This completes the air and oil circuit connected to the compressor stage 10.

An electrical control circuit, indicated generally by 40, is also provided for controlling the operation of the oil header tank 25. The electrical circuit 40 comprises two float switches F1, F2 connected in parallel to a power source 42. A main switch S and a relay R are connected respectively between the power source and opposite sides of the switches. A further switch R2 which is operated by relay R is connected in series with the switch S in the branch of the circuit including float switch F2. The float switch F2 which is mounted in the upper part of the oil header tank 25 is normally closed and opens when the oil level in the header tank rises to the float switch F2 (high oil condition). The float switch F1, which is mounted in the lower part of the oil header tank 25 is normally kept open by the oil but closes when the oil level falls below the switch F1 (low oil condition).

The circuit 40 is completed by a solenoid valve 43 which is mounted in the second pipe 26 for opening and closing the pipe 26. The solenoid valve 43 is also connected to the power source 42 in parallel with the two float switches F1, F2 and is controlled by a switch R1 which is also operated by relay R.

The operation of the above-described oil sealing system is as follows. The bearing 13 is of the centre-fed type and is lubricated by oil which is fed under pressure to the axial centre of the bearing by a radial drilling into the bearing. This oil flows outwardly from the centre of the bearing and forms a film around the shaft 12 which extends around the entire circumference of the shaft 12 and acts as a seal between air at pressure in the compressor stage and ambient air in the gearbox 15. This prevents the pressurisation of the gearbox.

Oil flowing from the impeller-end bearing 13 from its end within the chamber 16 enters the chamber 16 behind the impeller, immediately in front of the gearbox, thus contaminating the air within the chamber. This oil flows along the shaft 12 until it reaches the protrusion 19 which flings the oil outwardly from the shaft and the oil collects in the lower part of the chamber. From here the oil travels, via the large-bore pipe 24 (large-bore since in the "off-load" condition there is no air pressure behind the impeller to assist the flow) to the oil header tank 25.

In the "off-load" condition the large-bore tank exit pipe 26 dumps straight into the main tank: thus, when off-load, the header tank remains virtually empty.

When the machine goes "on-load", switch S, by a signal from the compressor control system, is closed; at this time, switch F1 is already closed and so relay R will be activated: this in turn closes switch R1, which shuts the solenoid valve 43, stopping the dump from header tank 25 to main tank 27; (this is necessary since otherwise a large air loss from behind the impeller would exist). The activation of relay R also closes switch R2, and since contacts F2 are already closed, this provides a self-hold circuit to R.

The header tank now starts to fill with oil. This, in a closed system would expel contaminated air into the impeller case and hence into the main air stream. To eliminate this condition, an air bleed path via pipes 32, 35, regulated by the needle valve 33, is incorporated. The bleed rate (by volume) is preset to a figure slightly higher than the rate at which the oil volume within the header tank increases. This latter rate is kept low by an oil bleed via pipe 29 which is set by needle valve 30 to a flow rate slightly lower than the oil flow rate from the bearing 13.

When the header tank oil level reaches the lower float switch, the contacts of this switch F1 open. It is to be noted that without the self-hold circuit through switch F2 the relay R would then deactivate, opening the dump, so that the oil level would flutter between two close levels governed by the opening and closing of switch F2.

The header tank 25 continues filling until the second float switch F2 is reached. The contacts of this switch F2 then open, the self-hold circuit breaks and relay R is deactivated, thus opening switches R1 and R2. The dump line 26 then reopens and the header tank 25 empties into the main tank 27 until switch F1 closes and the relay R reactivates thus returning to the start of the cycle. It will be noted that during the above operation, the header tank is pressurised while the main tank is at ambient pressure.

An alternative simplified embodiment of oil sealing system is illustrated in FIG. 2 and, in this Figure, like parts have the same reference numerals as in FIG. 1.

In this embodiment, the arrangement of the compressor stage 10 including the gearbox 15 and chamber 16 are identical to FIG. 1. However, in this embodiment the drain pipe 24 is connected directly to the main oil tank 27, with the solenoid valve 43 arranged in the pipe 24. A needle valve 30 forming an oil bleed is again in parallel with the solenoid valve 43 and a further oil pipe 50 connects the lower end of an oil chamber in the form of a sight glass 51 to the drain pipe 24 between the chamber outlet 28 and the solenoid valve 43. The sight glass 51 is arranged at the same height as the lower part of the chamber 16 and its upper end is connected to the aperture 36 by an air pipe 53.

The electrical circuit 40 for the system of FIG. 2 is as follows. The solenoid valve 43 is driven by a power source 42 and arranged in series with the solenoid valve 43 are a main switch S and the contacts of a float switch F2 which is mounted in the upper part of the sight glass 51. The float switch is normally closed and opens when the oil level in the sight glass (and thus in the chamber 16) rises to the level of float switch F2 (high oil condition).

The operation of the oil sealing system of FIG. 2 is as follows. The compressor stage 10 operates and the shaft 12 and bearing 13 are lubricated in exactly the same manner as described above for FIG. 1. Lubricating oil collects in the chamber 16 and drains via pipe 24. In the off-load condition of the compressor, the solenoid valve 43 is open and the pipe 24 thus dumps straight into the main tank 27. When the compressor goes on-load, the switch S is closed by a signal from the compressor control system. The float switch F2 is already closed and the electrical control circuit 40 is thus energized to close solenoid valve 43, stopping the dump from the chamber 16 to the main tank 27. The rate of flow of oil from the chamber 16 is now controlled by the needle valve 30 and this rate is set slightly higher than the rate of flow of oil through the bearing 13 so that, under normal operating conditions, the oil from chamber 16 together with a small amount of air will bleed through valve 30. However if the rate of oil flow into the chamber 16 increases, not all the oil will drain through valve 30 and the chamber 16 and sight glass 51 will start to fill with oil.

When the oil level reaches the float switch F2, this switch opens thus opening the circuit 40 so that the solenoid valve is de-energized and re-opens to again dump oil into the main tank 27.

It will be seen from the above description that the oil sealing systems described provide a means of controlling the air-oil flows around an impeller shaft which avoids the use of mechanical shaft seals which are both expensive and prone to failure, thus requiring regular replacement. The above system also allows a reduction in the distance between the impeller and the bearing and this can improve the impeller shaft dynamics.

Further advantages of this system are that contamination of the main air stream by the lubricating oil is avoided and air loss from the compressor stage is reduced to a minimum. In this respect, the oil flinger 19 is of assistance by its action of flinging oil passing axially along the shaft radially outwardly from the shaft thus minimising the danger of oil passing along the shaft and through the annular gap 23. Moreover, oil which does leak past the oil flinger 19 is largely prevented from passing into the impeller housing by the labyrinth seal or wind-back 31.

It will be realised that the invention is not limited to the preferred embodiment described above and various modifications may be made within the scope of the invention. For example, the needle valves 30, 33 may be replaced by orifices of suitable diameter.

I claim:

1. A compressor comprising at least one stage including an impeller mounted for rotation on a shaft and rotatable in an impeller housing, a transmission drivingly connected to the shaft, a bearing supporting the shaft and means to lubricate the bearing, the lubrication means providing a continuous lubricant seal around the shaft between the shaft and the bearing to prevent air leaking through the bearing, and the compressor further comprising a chamber located between the impeller housing and the bearing, an outlet from the chamber for draining lubricant from the chamber, a tank for lubricant connected to the chamber outlet, valve means for controlling the flow of lubricant from the chamber to the tank, the valve means comprising flow control valve means having a high flow rate condition and a low flow rate condition, and wherein the valve means comprises a first valve which is always open and a second valve switchable between closed and open conditions arranged in parallel with the first valve, for switching the valve means between its low and high flow rate conditions.

2. A compressor as claimed in claim 1 in which the lubrication means supplies lubricant under pressure to a part of the bearing spaced from the chamber so that a pressure difference is created across the bearing.

3. A compressor as claimed in claim 1 further comprising a header tank for lubricant collection arranged in the flow path between the chamber outlet and the valve means and further comprising an air bleed from the chamber and the header tank to the lubricant tank.

4. A compressor as claimed in claim 1 in which the first valve is a needle valve.

5. A compressor as claimed in claim 1 further comprising switching means for switching the valve means between low and high flow rate conditions, in use, said switching means switching said valve means into its low flow rate condition in response to a signal indicating that the compressor is on-load and switching said valve means into its high flow rate condition in response to a signal indicating that the compressor is off-load or that the oil level in the chamber has risen to a predetermined maximum height.

6. A compressor as claimed in claim 5 in which said second valve is a solenoid valve and said switching means is a control circuit including a power source, a switch responsive to a signal from the compressor and a float switch for determining the oil level in the chamber.

* * * * *